US008844245B2

(12) United States Patent
Schubert et al.

(10) Patent No.: US 8,844,245 B2
(45) Date of Patent: Sep. 30, 2014

(54) APPARATUS FOR PACKAGING BEVERAGES

(75) Inventors: Hubertus U. Schubert, Smyrna, GA (US); F. Fred Sadeghi, Marietta, GA (US); Alain Verbeke, Bangkok (TH)

(73) Assignee: The Coca-Cola Company, Atlanta, GA (US)

( * ) Notice: Subject to any disclaimer, the term of this patent is extended or adjusted under 35 U.S.C. 154(b) by 19 days.

(21) Appl. No.: 13/244,617

(22) Filed: Sep. 25, 2011

(65) Prior Publication Data

US 2012/0012227 A1 Jan. 19, 2012

Related U.S. Application Data

(62) Division of application No. 11/767,269, filed on Jun. 22, 2007, now Pat. No. 8,046,976.

(60) Provisional application No. 60/820,249, filed on Jul. 25, 2006.

(51) Int. Cl.

| | |
|---|---|
| ***B67B 3/06*** | (2006.01) |
| ***B67B 3/20*** | (2006.01) |
| ***B67C 3/02*** | (2006.01) |
| ***B67C 3/06*** | (2006.01) |
| ***B65B 3/24*** | (2006.01) |

(52) U.S. Cl.

CPC . *B65B 3/24* (2013.01); *B67C 3/023* (2013.01); *B67C 3/06* (2013.01)

USPC ..... 53/239; 53/240; 53/267; 141/100; 141/103

(58) Field of Classification Search

CPC ..... B67C 3/00; B67C 3/023; B67C 3/026; B67C 3/06; B67C 3/20; B67C 3/208; B67C 7/00; B65B 3/24

USPC ..... 53/467, 474, 237, 240, 266.1, 267, 239; 141/6, 103, 9, 100

See application file for complete search history.

(56) References Cited

U.S. PATENT DOCUMENTS 933,361 A 9/1909 Champ
1,709,577 A * 4/1929 Huntley ..... 53/267

(Continued)

FOREIGN PATENT DOCUMENTS

EP 0170209 A2 2/1986
EP 0354130 A 2/1990

(Continued)

OTHER PUBLICATIONS

JPO machine translation of JP 06-046752 A, from http://www4.ipdl.inpit.go.jp, retrieved May 22, 2014, 5 pages.*

(Continued)

*Primary Examiner* — Stephen F Gerrity
(74) *Attorney, Agent, or Firm* — Sutherland Asbill & Brennan LLP

(57) ABSTRACT

A method for packaging a beverage comprising particulates in a liquid, the method comprising dispensing a first portion of the beverage from a first source into containers, wherein the first portion of the beverage comprises at least a majority of the particulates and a first portion of the liquid, dispensing from a counterpressure filler a second portion of the beverage from a second source into the containers, wherein the second portion of the beverage comprises a second portion of the liquid, and sealing the containers to form packaged beverages. An apparatus for packaging a beverage comprising particulates in a liquid. A method for packaging, in sequence, a first beverage comprising particulates in a liquid and a second beverage comprising a carbonated beverage. A method for packaging a beverage comprising a dairy component and a liquid.

15 Claims, 4 Drawing Sheets

(56) References Cited

U.S. PATENT DOCUMENTS

| | | | | | |
|---|---|---|---|---|---|
| 2,103,158 | A | | 12/1937 | Kantor | |
| 2,372,899 | A | | 4/1945 | Kantor | |
| 2,695,743 | A | * | 11/1954 | Wetherby-Williams | 53/281 |
| 2,699,718 | A | | 1/1955 | Wright | |
| 2,743,047 | A | | 4/1956 | Clarke | |
| 2,796,892 | A | * | 6/1957 | Meyer | 141/48 |
| 2,988,450 | A | * | 6/1961 | Bulatkin | 426/399 |
| 3,018,804 | A | * | 1/1962 | Granier | 141/286 |
| 3,648,741 | A | | 3/1972 | Croasdale et al. | |
| 3,651,836 | A | | 3/1972 | Johnson | |
| 3,845,791 | A | * | 11/1974 | Friendship | 141/6 |
| 3,982,376 | A | * | 9/1976 | Ikeda | 53/239 |
| 4,201,031 | A | | 5/1980 | Wiles | |
| 4,509,690 | A | | 4/1985 | Austin et al. | |
| 4,551,342 | A | | 11/1985 | Nakel et al. | |
| 4,606,174 | A | * | 8/1986 | Berg | 53/239 |
| 4,608,810 | A | * | 9/1986 | Bordini | 53/551 |
| 4,684,332 | A | | 8/1987 | Hartley et al. | |
| 4,860,802 | A | * | 8/1989 | Yamaguchi et al. | 141/6 |
| 4,934,567 | A | | 6/1990 | Vahjen et al. | |
| 4,976,295 | A | * | 12/1990 | Clusserath | 141/39 |
| 4,989,650 | A | * | 2/1991 | Weiss | 141/6 |
| 5,038,548 | A | | 8/1991 | Sieg | |
| 5,082,033 | A | | 1/1992 | Weiss | |
| 5,168,905 | A | | 12/1992 | Phallen | |
| 5,293,909 | A | | 3/1994 | Weiss | |
| 5,494,692 | A | | 2/1996 | Beyer et al. | |
| 5,540,263 | A | * | 7/1996 | Hustvedt et al. | 141/103 |
| 5,642,761 | A | | 7/1997 | Holbrook | |
| 5,673,820 | A | * | 10/1997 | Green et al. | 222/129.3 |
| 5,687,779 | A | | 11/1997 | Andersson et al. | |
| 5,713,403 | A | * | 2/1998 | Clusserath et al. | 141/9 |
| 5,783,239 | A | | 7/1998 | Callens et al. | |
| 5,829,224 | A | * | 11/1998 | Sizer | 53/239 |
| 5,829,476 | A | | 11/1998 | Kaneko et al. | |
| 5,845,463 | A | | 12/1998 | Henaux | |
| 5,865,225 | A | * | 2/1999 | Weiss | 141/198 |
| 5,950,691 | A | * | 9/1999 | Abe et al. | 141/103 |
| 6,065,510 | A | | 5/2000 | Andersson et al. | |
| 6,170,707 | B1 | * | 1/2001 | Wolski et al. | 222/129.1 |
| 6,186,193 | B1 | | 2/2001 | Phallen et al. | |
| 6,202,894 | B1 | | 3/2001 | Struminski et al. | |
| 6,290,994 | B1 | | 9/2001 | Lazaro Flores et al. | |
| 6,367,519 | B2 | | 4/2002 | Thibiant et al. | |
| 6,371,172 | B2 | * | 4/2002 | Soehnlen et al. | 141/9 |
| 6,405,764 | B1 | | 6/2002 | Wang | |
| 6,457,495 | B1 | | 10/2002 | Meheen | |
| 6,463,964 | B2 | | 10/2002 | Clusserath | |
| 6,568,157 | B1 | * | 5/2003 | Futase | 141/9 |
| 6,615,880 | B2 | | 9/2003 | Hewlitt et al. | |
| 6,729,361 | B2 | * | 5/2004 | Noell | 141/9 |
| 6,742,552 | B2 | * | 6/2004 | Raniwala | 141/103 |
| 6,761,920 | B1 | | 7/2004 | Kaplan | |
| 6,772,806 | B2 | * | 8/2004 | De Villele | 141/103 |
| 8,046,976 | B2 | | 11/2011 | Schubert et al. | |
| 2001/0017815 | A1 | * | 8/2001 | Ackermann et al. | 366/152.2 |
| 2002/0014276 | A1 | * | 2/2002 | Clusserath | 141/40 |
| 2004/0084104 | A1 | | 5/2004 | Raniwala | |
| 2006/0011261 | A1 | | 1/2006 | Bonatti et al. | |

FOREIGN PATENT DOCUMENTS

| | | | | | |
|---|---|---|---|---|---|
| EP | 570122 | A2 | * | 11/1993 | B65B 25/00 |
| FR | 458451 | A | * | 10/1913 | B67C 3/208 |
| FR | 601805 | A | * | 3/1926 | B67C 3/208 |
| GB | 2068327 | A | * | 8/1981 | B65B 9/04 |
| JP | 06046752 | A | * | 2/1994 | A23C 9/133 |
| JP | 10338203 | A | * | 12/1998 | B65B 3/12 |
| JP | 2005204564 | A | * | 8/2005 | A23L 2/00 |
| WO | 2008/014333 | A2 | | 1/2008 | |

OTHER PUBLICATIONS

Disclosure Under 37 CFR 1.56, dated Jul. 30, 2013, for U.S. Appl. No. 13/244,617, 1 page.

International Preliminary Report on Patentability for PCT/US2007/074344, completed Nov. 7, 2008, 9 pages.

International Search Report and Written Opinion for PCT/US2007/074344, mailed Mar. 4, 2008, 19 pages.

European Examination Report dated Oct. 10, 2011 for Appln. No. EP 07799805.2, 5 pages.

European Search Report dated Mar. 5, 2014 for Application No. EP 13188183.1, 6 pages.

European Search Report dated Mar. 5, 2014 for Application No. EP 13188185.6, 6 pages.

* cited by examiner

APPARATUS FOR PACKAGING BEVERAGES

This application is a divisional application of U.S. patent application Ser. No. 11/767,269, filed Jun. 22, 2007, now U.S. Pat. No. 8,046,976, which claims priority under 35 U.S.C. §119 (e) U.S. Provisional Application No. 60/820,249, filed Jul. 25, 2006, the specifications of which are expressly incorporated herein by reference in their entirety.

TECHNICAL FIELD

This invention relates to packaging beverages comprising particulates in a liquid and packaging in sequence beverages comprising particulates in a liquid and carbonated beverages. This invention also relates to packaging beverages comprising a dairy component and a liquid and packaging in sequence beverages comprising a dairy component and a liquid and carbonated beverages or beverages comprising particulates.

BACKGROUND OF THE INVENTION

Beverages comprising high quantities of fibers, pulp, or other particulates have generally been dispensed into containers by special fillers. Such fillers are typically designed for non-carbonated beverages (NCBs). Correspondingly, the packaging process of carbonated beverages has been carried out on separate, counterpressure fillers such as carbonated soft-drink (CSD) fillers. The packaging of dairy products also has generally been carried out on fillers separate from counterpressure fillers for drinks such as carbonated beverages. Therefore, a bottling plant which produces both non-carbonated beverages comprising particulates and carbonated soft-drinks must utilize both the special fillers for the pulpous beverages and counterpressure fillers for the CSDs. Likewise, a bottling plant which produces both beverages containing dairy components and carbonated soft-drinks must utilize both the fillers for the beverages containing diary components and counterpressure fillers for the CSDs.

Attempts to use counterpressure fillers to dispense beverages comprising particulates having an average size over about 3 millimeters (mm) and comprising particulates in an amount of about 0.5% by weight of the beverage have resulted in particulate buildup inside the counterpressure filling equipment. The particulate buildup clogs counterpressure filling equipment and leads to malfunctioning of the filling equipment. For example, clogged counterpressure filling valve vent tubes dispense unequal volumes of the beverage being dispensed into the beverage containers. Thus, the residual fiber clogs must be removed from the counterpressure filler equipment by cleaning-in-place (CIP) procedures which result in a shorter operational up-time. In addition, the residual fiber clogs result in particulate and product loss.

Accordingly, there is a need for a simple and economically desirable method and apparatus for packaging beverages comprising particulates in a liquid with counterpressure fillers without the above mentioned shortcomings. In addition, there is a need for a simple and economically desirable method and apparatus for packaging beverages comprising dairy components and CSDs.

SUMMARY OF THE INVENTION

This invention addresses the above described need in the art by providing a method for packaging a beverage comprising particulates in a liquid, the method comprising dispensing a first portion of the beverage from a first source into containers, wherein the first portion of the beverage comprises at least a majority of the particulates and a first portion of the liquid, dispensing from a counterpressure filler a second portion of the beverage from a second source into the containers, wherein the second portion of the beverage comprises a second portion of the liquid, and sealing the containers to form packaged beverages.

More particularly, this invention encompasses a method for decreasing container-to-container variation in pulp content in a packaged pulpous beverage and reducing pulp buildup in an apparatus comprising a counterpressure filler, the method comprising dispensing a first portion of the pulpous beverage from a first chamber into containers, wherein the first portion of the pulpous beverage comprises substantially all of the pulp and a first portion of beverage liquid, dispensing from the counterpressure filler a second portion of the pulpous beverage from a second chamber into the containers, wherein the second portion of the pulpous beverage comprises a second portion of beverage liquid and is substantially pulp free, and sealing the containers to form packaged pulpous beverages.

In addition, this invention encompasses an apparatus for packaging a first beverage comprising particulates in a liquid, the apparatus comprising a first source for providing a first portion of the first beverage comprising at least a majority of the particulates and a first portion of the liquid, a second source for providing a second portion of the first beverage comprising a second portion of the liquid, a dispenser for dispensing the first portion of the first beverage from the first source into a first plurality of containers, a counterpressure filler for dispensing the second portion of the first beverage from the second source into the first plurality of containers, and a sealer for sealing the first plurality of containers to form packaged first beverages.

Furthermore, this invention encompasses a method for packaging in sequence a first beverage comprising particulates in a liquid and a second beverage comprising a carbonated beverage, the method comprising (1) packaging the first beverage in a first process comprising dispensing a first portion of the first beverage from a first source into first containers, wherein the first portion of the first beverage comprises at least a majority of the particulates and a first portion of the liquid, dispensing from a counterpressure filler a second portion of the first beverage from a second source into the first containers, wherein the second portion of the first beverage comprises a second portion of the liquid, and sealing the first container to form packaged first beverages and (2) packaging the second beverage in a second process comprising dispensing from the counterpressure filler the carbonated beverage from a third source into second containers and sealing the second containers to form packaged second beverages.

This invention addresses the above described need in the art by providing a method for packaging a beverage comprising a dairy component and a liquid. The method comprises dispensing a first portion of the beverage from a first source into containers, dispensing from a counterpressure filler a second portion of the beverage from a second source into the containers, and sealing the containers to form packaged beverages. The first portion of the beverage comprises the dairy component and the second portion of the beverage comprises the liquid.

More particularly, this invention encompasses a method for decreasing container-to-container variation in dairy component content in a beverage. The method comprises dispensing a first portion of the beverage from a first chamber into containers, dispensing from the counterpressure filler a second portion of the beverage from a second chamber into the containers, and sealing the containers to form packaged beverages. The first portion of the beverage comprises the dairy component and the second portion of the beverage comprises a liquid.

In addition, this invention encompasses an apparatus for packaging a first beverage comprising a dairy component and a liquid. The apparatus comprises a first source for providing a first portion of the first beverage comprising the dairy component, a second source for providing a second portion of the first beverage comprising the liquid, a dispenser for dispensing the first portion of the first beverage from the first source into a first plurality of containers, a counterpressure filler for dispensing the second portion of the first beverage from the second source into the first plurality of containers, and a sealer for sealing the first plurality of containers to form packaged first beverages.

Furthermore, this invention encompasses a method for packaging in sequence a first beverage comprising a dairy component and a liquid and a second beverage comprising a carbonated beverage. The method comprises (1) packaging the first beverage in a first process comprising dispensing a first portion of the first beverage from a first source into first containers, dispensing from a counterpressure filler a second portion of the first beverage from a second source into the first containers and sealing the first container to form packaged first beverages and (2) packaging the second beverage in a second process comprising dispensing from the counterpressure filler the carbonated beverage from a third source into second containers and sealing the second containers to form packaged second beverages. The first portion of the first beverage comprises the dairy component and the second portion of the first beverage comprises the liquid.

Other objects, features, and advantages of this invention will be apparent from the following detailed description, drawing, and claims.

DETAILED DESCRIPTION OF EMBODIMENTS

As summarized above, this invention encompasses a method for packaging a beverage comprising particulates in a liquid, a method for decreasing container-to-container variation in pulp content in a packaged pulpous beverage and reducing pulp buildup in an apparatus comprising a counterpressure filler, an apparatus for packaging a first beverage comprising particulates in a liquid, a method for packaging in sequence a first beverage comprising particulates in a liquid and a second beverage comprising a carbonated beverage, a method for packaging a beverage comprising a dairy component and a liquid, a method for decreasing container-to-container variation in dairy component content in a packaged beverage, an apparatus for packaging a first beverage comprising a dairy component and a liquid, and a method for packaging in sequence a first beverage comprising a dairy component and a liquid and a second beverage comprising a carbonated beverage. Embodiments of this invention are described in detail below and illustrated in FIG. 1.

Figure 1:
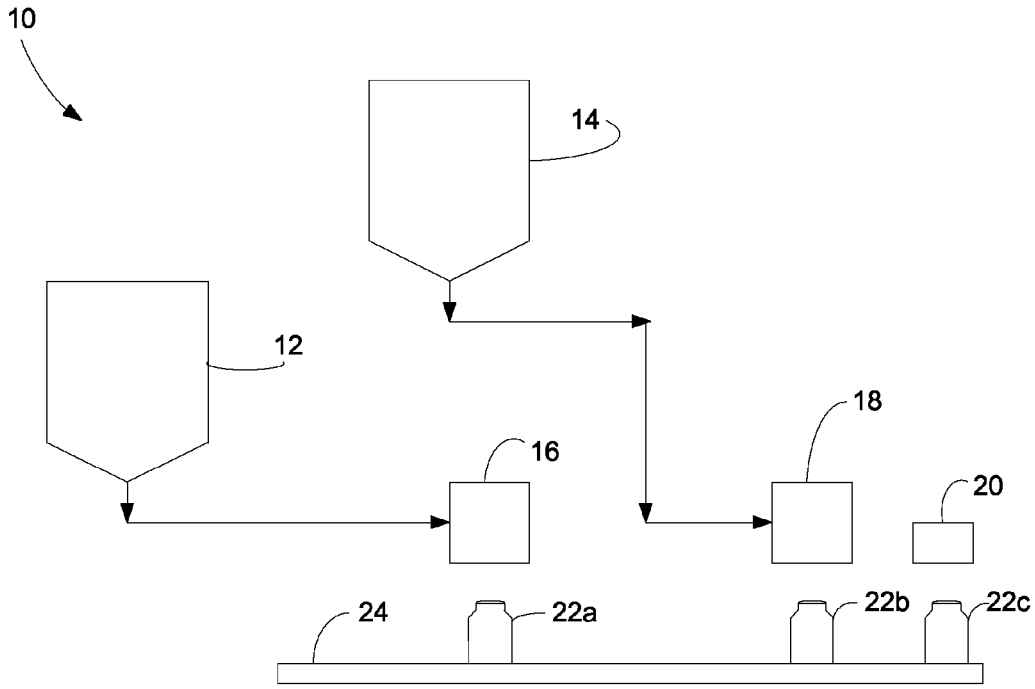
FIG. 1 is schematic illustration of an apparatus for packaging a beverage comprising particulates in a liquid made in accordance with an embodiment of the present invention.

FIG. 1 illustrates an apparatus 10 for continuously packaging a beverage comprising particulates in a liquid made in accordance with an embodiment of the present invention and, as described in more detail herein below. The apparatus 10 can also be used for continuously packaging a beverage comprising a dairy component in accordance with an embodiment of the present invention. Thus, the apparatus 10 can also be used to manufacture both carbonated beverages and non-carbonated beverages (with or without particulates or a dairy component) in sequence, switching from one to the other and back again. The apparatus 10 comprises a first source 12 for providing a first portion of the beverage and a second source 14 for providing a second portion of the beverage, a dispenser 16 for dispensing the first portion of the beverage, a filler 18 for dispensing the second portion of the beverage, and a sealer 20, such as a bottle capper, for sealing a container 22*c* filled with the beverage to form packaged beverages for later consumption. The first and second sources 12 and 14 can be any article or vessel suitable for providing the first and second portions of the beverage separate from one another such as tanks, vats, drums, hoppers, pipes, and the like. First and second sources 12 and 14 in accordance with this embodiment 10 are chambers which store the first and second portions of the beverage, respectively, separate from one another.

Filler 18 for dispensing the second portion of the beverage in accordance with this embodiment 10 is a continuous counterpressure filler, which normally would not be suitable for dispensing a liquid containing particulates. More particularly, the counterpressure filler in FIG. 1 is a CSD filler, but it should be understood that this invention also encompasses other counterpressure fillers such as beer fillers. It should be understood, however, that the filler 18 for dispensing the second portion of the beverage could also be a filler, other than a counterpressure filler, that also is not normally suitable for dispensing a liquid containing particulates.

Examples of suitable beverages which may be packaged using embodiments of this invention include, but are not limited to different types of water, fruit juices, vegetable juices, or combinations thereof. For instance, the fruit juices may include, but are not limited to, a citrus juice such as orange juice, grapefruit juice, lime juice, lemon juice, pineapple juice, or combinations thereof. In some embodiments, juice is present in the beverage in an amount ranging from about 10% by weight of the beverage to about 100% by weight of the beverage. In other embodiments, the beverage may comprise whole milk, skim milk, lowfat milk, fat-free milk, reconstituted powdered milk, a milk drink, whey, coffee, espresso, chocolate, a soy product, or combinations thereof. In some embodiments, the liquid portion of the beverage comprises additional components including, but not limited to, water, sugar, pectin, nutritive sweeteners, preservatives, vitamins, flavorings, phytosterols, probiotics, or prebiotics, or combinations thereof. In some embodiments, the particulates in the beverage may comprise, but are not limited to, pulp, fibers, gels, fruit particles, vegetable particles, or combinations thereof. In addition, the particulates may be water insoluble in some embodiments. Furthermore, in some embodiments, the particulates may have an average particulate size greater than about 3 millimeters (mm).

According to particular embodiments of the invention, the first portion of the beverage, which is stored in the first chamber 12, comprises at least a majority of the particulates and a first portion of the liquid. In alternate embodiments (not shown), the first portion of the liquid may be provided to the first chamber 12 from the second chamber 14 in a separation step where particulates and some liquid are separated from contents in the second chamber using separation techniques well know to those skilled in the art. The quantity of particulates in the first portion of the beverage should be such that the first portion of the beverage is transferable to the dispenser 16. For example, the quantity of particulates could be such that the first portion of the beverage has a viscosity which makes it pumpable to the dispenser 16 from the first chamber 12. Generally, the particulate quantity in the first portion of the beverage is dependant upon the desired composition of the beverage. In particular, the particulates may be present in first portion of the beverage in an amount ranging from 10% by weight of the first portion of the beverage to about 80% by weight of the first portion of the beverage. More particularly, the particulates are present in the first portion of the beverage in an amount ranging from about 25% by weight of the first portion of the beverage to about 75% by weight of the first portion of the beverage. Still more particularly, the particulates are present in the first portion of the beverage in an amount ranging from about 50% by weight of the first portion of the beverage to about 60% by weight of the first portion of the beverage.

According to other embodiments of the present invention, the first portion of the beverage, which is stored in the first chamber 12, comprises a dairy component. For example, the dairy component may comprise milk fat, curds, powdered milk, yogurt, whole milk, skim milk, lowfat milk, fat-free milk, whey, or combinations thereof. In some embodiments, the dairy component may comprise a powder, a solution, a dispersion, a colloid, or an emulsion. In particular embodiments, the dairy component may be present in the beverage in each container in an amount ranging from about 0.5% by weight of the beverage to about 50% by weight of the beverage. More particularly, the dairy component may be present in the beverage in each container in an amount ranging from about 0.5% by weight of the beverage to about 25% by weight of the beverage. Still more particularly, the dairy component may be present in the beverage in each container in an amount ranging from about 3% by weight of the beverage to about 10% by weight of the beverage.

In yet other embodiments of the present invention, the first portion of the beverage may comprise additives such as vitamins, flavorings, phytosterols, probiotics, or prebiotics, or combinations thereof. In alternate embodiments of the present invention, the first portion of the beverage may comprise additives in combination with a dairy component.

The second portion of the beverage, which is stored in the second chamber 14, comprises a second portion of the liquid. The composition of the second portion of the liquid may be different from the composition of the first portion of the liquid. For example, the first portion of the liquid may comprise a juice concentrate and the second portion of the liquid may comprise water. In some embodiments, the second portion of the beverage may comprise a "white paint" composition, while the first portion of the beverage comprises any of a juice, a dairy component, a flavor, texture, additive, sweetener, or combinations thereof or the like which imparts the taste of the beverage perceived by the consumer. In particular embodiments, the first portion of the beverage comprises substantially all of the particulates and the second portion of the beverage is substantially particulate free. For instance, in accordance with particular embodiments, the particulates may be present in the first portion of the beverage in an amount ranging from about 10% by weight of the first portion of the beverage to about 80% by weight of the first portion of the beverage and the particulates may be present in the second portion of the beverage in an amount ranging from about 0% by weight of the second portion of the beverage to about 1% by weight of the second portion of the beverage. In general, the particulate concentration in the second portion of the beverage should be such that particulate buildup inside the counterpressure filling equipment is eliminated or substantially reduced.

In other embodiments, where the first portion of the beverage comprises a dairy component, the second portion of the beverage, which is stored in the second chamber 14, generally comprises the liquid. Suitable examples of the liquid include, but are not limited to, whole milk, skim milk, lowfat milk, fat-free milk, whey, water, a fruit juice, a vegetable juice, coffee, espresso, chocolate, a soy product, or combinations thereof. It should be understood, however, that the dairy component may include constituents which are also contained in the liquid. For example, in one embodiment, the dairy component may comprise milk fat and fat-free milk while the liquid comprises fat-free milk.

Figure 2:
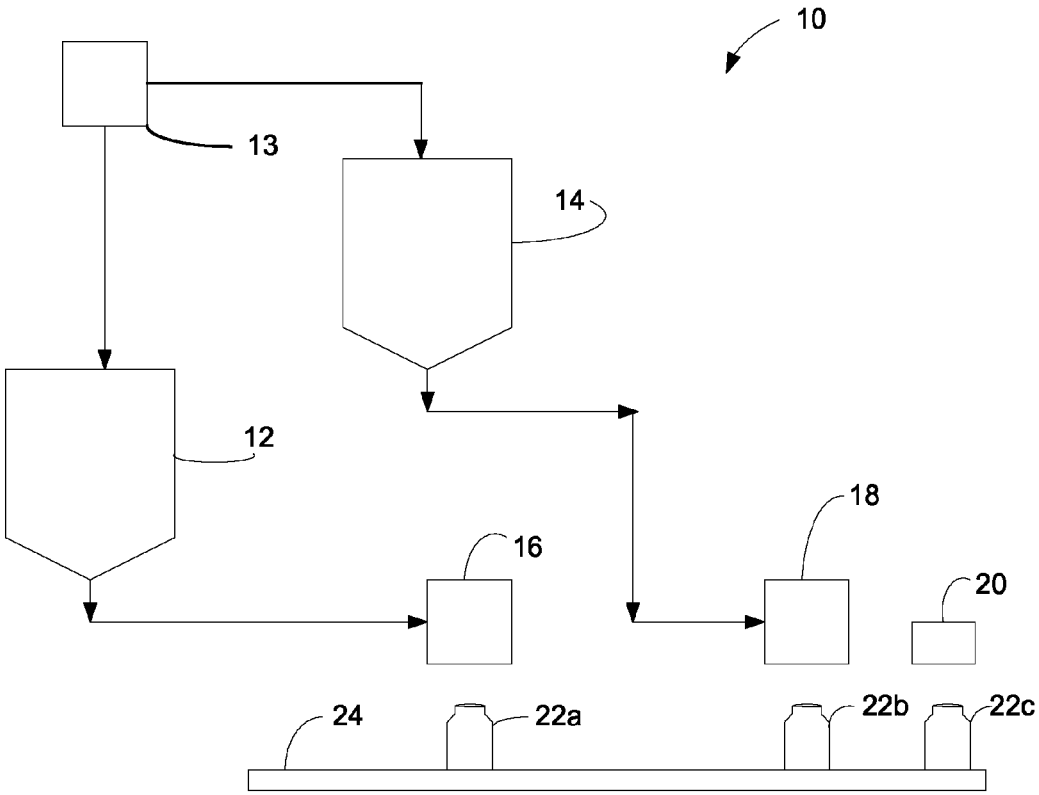
FIG. 2 is a schematic illustration of an apparatus for packaging a beverage comprising particulates in a liquid made in accordance with an embodiment of the present invention.

In alternate embodiments, as shown in FIG. 2, the apparatus 10 may further comprise a particulate separator 13 upstream from the first and second chambers 12 and 14 which produces the first and second portions of the beverage by separating at least a majority of the particulates and a portion of the liquid from a second portion of the liquid. In such embodiments, the beverage comprising particulates in a liquid is first supplied to the particulate separator. Next, the particulate separator produces the first and second portions of the beverage which are stored in the first and second chambers 12 and 14, respectively. It should be understood that the particulate separator can be any device suitable for separating a beverage comprising particulates in a liquid into a first portion comprising at least a majority of particulates and a portion of the liquid and a second portion comprising a second portion of the liquid. Thus, in some embodiments, the apparatus 10 separates a beverage comprising particulates in a liquid, such as orange juice, for example, into the first and second portions of the beverage for packaging of the beverage in accordance with embodiments of the present invention.

In the embodiment of the present invention illustrated in FIG. 1, the packaging of the beverage comprises a continuous, high volume beverage packaging process wherein the first portion of the beverage is transferred from the first chamber 12 to the dispenser 16, where the first portion of the beverage is dispensed into a container 22*a*. The quantity of the first portion of the beverage which is dispensed or dosed into each container 22*a* depends upon the composition of the first portion of the beverage and the desired resultant composition of the beverage. In particular embodiments, the first portion of the liquid can be present in the container 22*a* in an amount ranging from about 1% by volume of the container to about 15% by volume of the container.

Examples of suitable dispensers 16 for dispensing the first portion of the beverage in accordance with particular embodiments include, but are not limited to, piston valve fillers, net weight fillers, or volumetric fillers with flow meters. For example, piston valve fillers can be configured to dispense the first portion of the beverage at the desired dosing volumes with little or no buildup of the particulates or dairy components. In particular embodiments, the configuration of the piston valve fillers may comprise ball valves which mechanically open and close to dose the desired amount of the first portion of the beverage into the container 22*a*. In addition, cleaning-in-place (CIP) may be carried out through the same channel from which the first portion of the beverage is fed into the piston valve. In other embodiments, the configuration of the piston valve fillers may additionally comprise a circulation line which circulates a portion of the first portion of the beverage back to the first chamber 12. In particular embodiments, the dispensing of the first portion of the beverage from the dispenser 16 can be carried out on an inline rotary filling device or on a linear multiple station filling system, where filling is activated to a population of containers intermittently.

Next, the container 22*a* is conveyed by a conveyer 24 to the CSD filler 18, where the second portion of the beverage is dispensed from the second chamber 14 by the CSD filler 18 into the container 22*b*, which already contains the appropriate dose of the first portion of the beverage. As with the dispensing of the first portion of the beverage, the dispensing of the second portion of the beverage from the CDS filler 18 may be carried out on an inline rotary filling device or on a linear multiple station filling system. In addition, it should be understood that though the conveyer 24 is illustrated as a belt system in this embodiment, other conveying means may be used, including rotary or linear neck handling devices. The second portion of the beverage fills the remainder of the container 22*b* volume. Thus, in particular embodiments, the first portion of the beverage and the second portion of the beverage may constitute the final beverage. In particular embodiments, since at least a majority of the particulates are in the first portion of the beverage, particulate buildup in the CSD filler 18 is reduced or eliminated during the dispensing of the second portion. As a result of the reduction or elimination of the particulate buildup, problems such as clogged vent tubes of filler valves are avoided and the container-to-container variation in pulp content in each container is also decreased. It should also be understood by a person of ordinary skill in the art that an inert gas such as nitrogen or nitrous oxide may be added to the non-carbonated beverage being packaged.

Additionally, having the first chamber 12 for storing the first portion of the beverage and the second chamber 14 for storing the second portion of the beverage results in greater processing flexibility, since a variety of beverages having various particulates and particulate quantities and dairy components and diary component quantities may be processed on the same apparatus. For example, changes to the amount of particulate in the beverage may be effectuated by changing the amount of particulate in the first portion of the beverage or by changing the dose of the first portion of the beverage dispensed. In addition, having a higher concentration of particulates in the first portion of the beverage generally contributes to a more accurate and consistent dosing of the particulates in the packaged beverage in each container. The same considerations are applicable for the dairy component. Furthermore, various countries may have differing laws governing the labeling of a beverage as a "juiced drink", and thus, embodiments of the present invention allow for packaging of various juice drinks with the doses required to correspond to the appropriate governing laws.

According to particular embodiments of this continuous, high volume beverage packaging process, the apparatus could be configured to form packaged beverages at a rate of at least 100 per minute. In one embodiment, the apparatus is configured to form packaged beverages at a rate of at least 600 per minute.

In particular embodiments, dispensing of the first portion of the beverage into the container 22 before dispensing of the second portion of the beverage results in less splashing and/or partial filling of the container 22, since the second portion of the beverage is typically less viscous than the first portion of the beverage. In addition, it may be desirable to dispense the first portion of the beverage before dispensing the second portion of the beverage to achieve better mixing of the particulates or dairy component and the liquid in the container. However, it should be understood that the dispensing of the second portion of the beverage with the CSD filler 18 may be carried out before dispensing of the first portion of the beverage with the dispenser 16. In such embodiments, the arrangement of the apparatus 10 must take into consideration parameters such as, but not limited to, longer vent tubes on the CSD filler 18 to maintain the headspace volume required to dose the particulates or dairy component and decoupling of the sealer from the CSD filler.

According to particular embodiments of the invention, the particulates can be present in the beverage in the container 22*c* in an amount ranging from about 0.1% by weight of the beverage to about 80% of by weight of the beverage. More particularly, the particulates can be present in the beverage in the container 22*c* in an amount ranging from about 0.1% by weight of the beverage to about 40% of by weight of the beverage. Still more particularly, the particulates can be present in the beverage in the container 22*c* in an amount ranging from about 0.1% by weight of the beverage to about 6% of by weight of the beverage.

Figure 3:
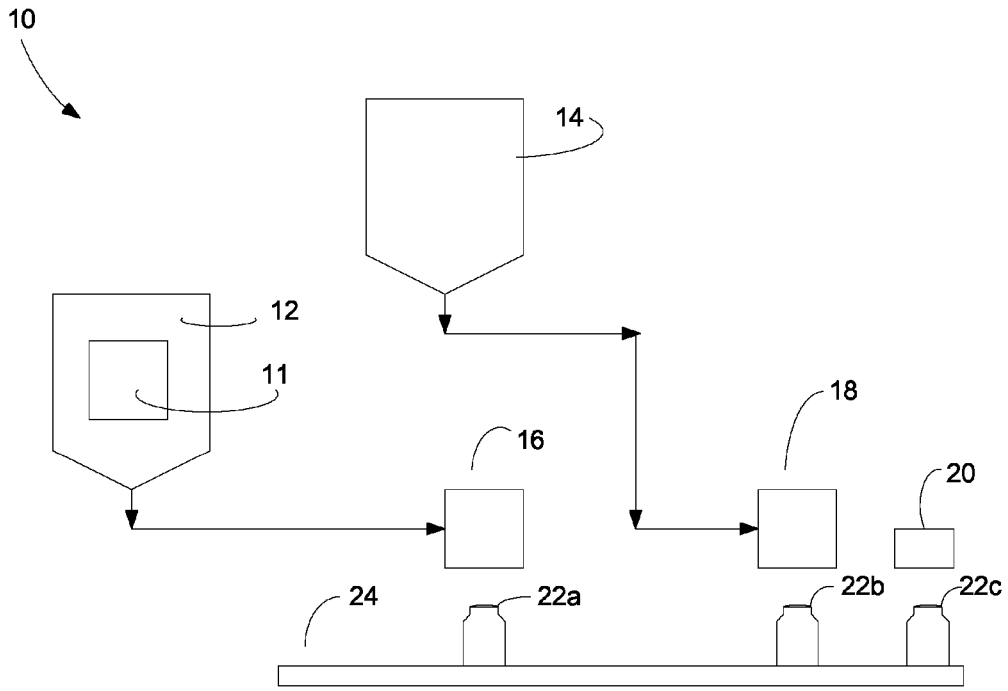
FIG. 3 is a schematic illustration of an apparatus for packaging a beverage comprising particulates in a liquid made in accordance with an embodiment of the present invention.

In other embodiments, as shown in FIG. 3, the apparatus 10 may also comprise an agitator 11 in the first chamber 12 for agitating the first portion of the beverage. It should be understood, however, that other agitation means known in the art may be used, including the placement of stationary baffles within the first chamber 12. Agitation of the first portion of the beverage allows separation of the particulates from the liquid to be avoided inside the first chamber 12. In particular embodiments, the agitation of the first portion of the beverage may be effective to disperse the particulates in the first portion of the liquid substantially homogenously. Since the particulates are dispersed in the first portion of the liquid, variation of the particulate concentration in the first portion of the beverage and in the resulting beverage is reduced or eliminated.

According to particular embodiments of the present invention, microbiological sterilization of the beverage can alternatively performed. For example, high temperature short time treatment (HTST) of the first portion of the beverage and/or the second portion of the beverage may be performed before each are dispensed into the container 22 at ambient temperatures. In another embodiment, cold dispensing of the first portion of the beverage and/or the second portion of the beverage may be performed and a preservative may be added to the first portion of the beverage and/or the second portion of the beverage. In yet another embodiment, either the first portion of the beverage or the second portion of the beverage or both may be hot dispensed and the filled container 22*b* may be cooled, for example, in a evaporation cooler. In an alternate embodiment, the capped container 22*c* may be post-fill sterilized by, for example, tunnel pasteurization or retorting. It should be understood that multiple sterilization methods may be used in combination with each other. Use of sterilization methods such as tunnel pasteurization allow in particular embodiments of the present invention to produce a beverage comprising a milk drink having a pH less than about 4.6 which is shelf stable at room temperature. In alternate embodiments, first portion of the beverage, the second portion of the beverage, or both may be aseptic.

In addition to methods and apparatuses for packaging a beverage comprising particulates in a liquid, the present invention provides methods for packaging a carbonated beverage and a non-carbonated beverage (with or without particulates) on the same apparatus. Thus, the apparatus 10 may be used for packaging, in sequence, a first beverage comprising particulates in liquid and a second beverage comprising a carbonated beverage. For example, the apparatus 10 could be used to package the first beverage as described above. Then, when it is desired to package the second beverage, the second chamber 14 may be emptied and cleaned so that it may be used to store the second beverage. Containers 22 are conveyed by the conveyer 24 directly to the counterpressure filler 18. At that point, the second beverage may be transferred from the second chamber to the counterpressure filler 18 and dispensed into the containers 22*b*. The containers 22*c* filled with the second beverage can be subsequently conveyed to the sealer 20 to be sealed to foam packaged carbonated beverages.

When it is desired to again package the first beverage or any other beverage comprising particulates in a liquid, the second chamber 14 may be emptied and cleaned so that it may be used to store the first portion of the first beverage. Such a process can be repeated as desired for efficient packaging, in sequence, of beverages comprising particulates in liquid and carbonated beverages on the same apparatus. Likewise, the present invention provides methods for packaging a carbonated beverage and a non-carbonated beverage including a dairy component and a liquid on the same apparatus.

Figure 4:
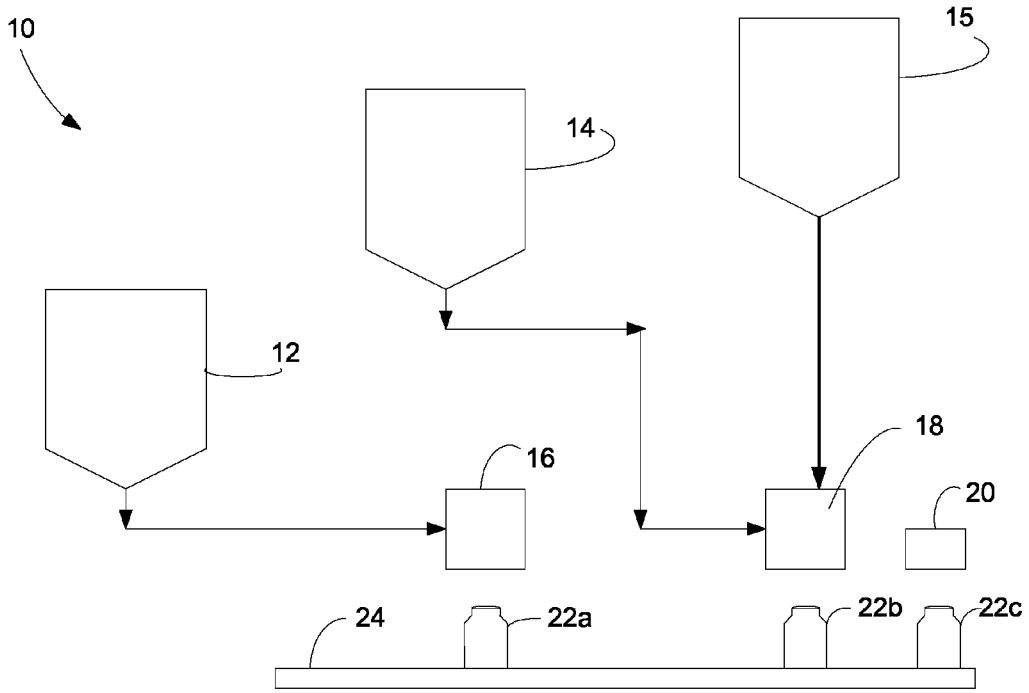
FIG. 4 is a schematic illustration of an apparatus for packaging a beverage comprising particulates in a liquid made in accordance with an embodiment of the present invention.

In alternate embodiments, as shown in FIG. 4, the carbonated beverage may be stored or provided by a third chamber or source 15. In such embodiments, there may be a valve or control device which allows the flow of the second portion of a beverage comprising particulates to the counterpressure filler 18 to be stopped when flow of the carbonated beverage to the counterpressure filler is desired, and vice versa.

Examples of suitable carbonated beverages which may be packaged using embodiments of this invention include, but are not limited to, carbonated-soft drinks, carbonated water, or beer.

The present invention is further illustrated below in an example which is not to be construed in any way as imposing limitations upon the scope of the invention. On the contrary, it is to be clearly understood that resort may be had to various other embodiments, modifications, and equivalents thereof which, after reading the description therein, may suggest themselves to those skilled in the art without departing from the scope of the invention and the appended claims.

EXAMPLE

In a particular embodiment of the present invention, an apparatus comprising piston valves and a CSD filler was used to dispense a beverage comprising pulp particulates in a liquid. The liquid comprised orange juice (15.59 Brix), pectin, sugar, Vitamin E, and preservatives (185 parts per million). The pulp was present in the beverage in an amount of 3% by weight of the beverage. The juice was present in the beverage in an amount of 10% by weight of the beverage. The first portion of the beverage was stored in a first chamber and comprised pulp in an amount of about 50% by weight of the first portion of the beverage. The beverage was packaged in 250 milliliter containers. The piston valves dosed about 35 milliliters of the first portion of the beverage into each of the containers.

It should be understood that the foregoing relates to particular embodiments of the present invention, and that numerous changes may be made therein without departing from the scope of the invention as defined from the following claims.

We claim:

1. An apparatus for packaging a first beverage, the apparatus comprising:

a first source comprising a first portion of a liquid and a first portion of particulates insoluble in the liquid;

a second source comprising a second portion of the liquid;

a dispenser connected to the first source;

a counterpressure filler connected to the second source;

a first container that receives the first portion of the liquid and the first portion of the particulates from the dispenser and receives the second portion of the liquid from the filler; and a sealer for sealing the first container to form a packaged first beverage, wherein the apparatus is capable of packaging non-carbonated and carbonated beverages.

2. Apparatus as in claim 1, further comprising:

a third source comprising a carbonated beverage and connected to the filler; and a second container that receives the carbonated beverage from the filler;

wherein the sealer is adapted to seal the first container to form a packaged first beverage and the second container to form a packaged second beverage.

3. Apparatus as in claim 1, wherein the dispenser comprises one or more piston valves configured to dispense the first portion of the liquid and the first portion of the particulates.

4. Apparatus as in claim 1, wherein the first source further comprises a chamber, tank, vat, drum, hopper or pipe and the second source further comprises a chamber, tank, vat, drum, hopper, or pipe.

5. Apparatus as in claim 1, wherein the counterpressure filler comprises a carbonated soft-drink filler or a beer filler.

6. Apparatus as in claim 1, further comprising a particulate separator configured to separate the first portion of the liquid and the first portion of the particulates from the second portion of the liquid, provide the first portion of the liquid and the first portion of the particulates to the first source, and provide the second portion of the liquid to the second source.

7. Apparatus as in claim 1, wherein the first source further comprises a first chamber having an agitator disposed therein for agitating the first portion of the liquid and the first portion of the particulates.

8. Apparatus as in claim 1, wherein the apparatus is configured to form packaged first beverages at a rate of at least 100 per minute.

9. Apparatus as in claim 1, wherein the apparatus is configured to form packaged first beverages at a rate of at least 600 per minute.

10. Apparatus as in claim 1, wherein the second source further comprises a second portion of particulates smaller than the first portion of particulates, and the first container receives the second portion of the liquid and the second portion of the particulates from the filler.

11. Apparatus as in claim 1, wherein the particulates comprise pulp.

12. Apparatus as in claim 1, wherein the particulates have an average particulate size greater than about 3 mm.

13. Apparatus as in claim 1, wherein the counterpressure filler is not suitable for dispensing a liquid containing particulates.

14. An apparatus for packaging a first beverage, the apparatus comprising:

a first source comprising a first portion of a liquid and a first portion of particulates insoluble in the liquid;

a second source comprising a second portion of the liquid;

a dispenser connected to the first source;

a counterpressure filler connected to the second source;

a first container that receives the first portion of the liquid and the first portion of the particulates from the dispenser and receives the second portion of the liquid from the counterpressure filler; and a sealer for sealing the first container to form a packaged first beverage.

15. Apparatus as in claim 14, wherein the second source further comprises a second portion of particulates that is smaller than the first portion of particulates.

* * * * *